US008763927B2

(12) United States Patent
Collings et al.

(10) Patent No.: US 8,763,927 B2
(45) Date of Patent: Jul. 1, 2014

(54) ULTRASONIC TRANSDUCER SYSTEMS

(75) Inventors: Anthony Collings, Turramurra (AU); Paul Gwan, Epping (AU)

(73) Assignee: Commonwealth Scientific and Industrial Research Organisation, Campbell, Australian Capital Territory (AU)

( * ) Notice: Subject to any disclaimer, the term of this patent is extended or adjusted under 35 U.S.C. 154(b) by 679 days.

(21) Appl. No.: 12/226,462

(22) PCT Filed: Apr. 18, 2007

(86) PCT No.: PCT/AU2007/000502

§ 371 (c)(1),
(2), (4) Date: Jan. 21, 2009

(87) PCT Pub. No.: WO2007/118285

PCT Pub. Date: Oct. 25, 2007

(65) Prior Publication Data

US 2009/0308487 A1 Dec. 17, 2009

(30) Foreign Application Priority Data

Apr. 19, 2006 (AU) ..... 2006902034

(51) Int. Cl.
*B05B 1/08* (2006.01)

(52) U.S. Cl.
USPC ..... 239/102.1; 239/102.2

(58) Field of Classification Search
CPC ..... B05B 17/06; B05B 17/0607
USPC ..... 141/3–5, 11, 20; 239/102.1, 102.2
See application file for complete search history.

(56) References Cited

U.S. PATENT DOCUMENTS

| | | | | |
|---|---|---|---|---|
| 4,437,497 | A * | 3/1984 | Enander | 141/1 |
| 4,999,976 | A * | 3/1991 | Smith | 53/470 |
| 6,744,899 | B1 * | 6/2004 | Grunberg | 381/343 |
| 6,925,187 | B2 * | 8/2005 | Norris et al. | 381/191 |
| 2001/0033124 | A1 | 10/2001 | Norris et al. | |
| 2002/0128328 | A1 | 9/2002 | Varadaraj | |

FOREIGN PATENT DOCUMENTS

| | | |
|---|---|---|
| EP | 0885641 B1 | 12/1998 |
| GB | 2341742 A | 3/2000 |
| JP | 07-046693 | 2/1995 |
| JP | 10-85509 | 4/1998 |
| WO | WO 91/18486 A1 | 11/1991 |

OTHER PUBLICATIONS

International Preliminary Report on Patentability and Written Opinion of the International Search Authority for PCT Application No. PCT/AU2007/000502, 5 pages, Jul. 24, 2007.

Search Report for PCT Application No. PCT/AU2007/000502, 3 pages, Jul. 24, 2007.

Extended European Search Report dated May 14, 2012 for corresponding European Application No. 07 718 749.0, 6 pages.

* cited by examiner

*Primary Examiner* — Davis Hwu
(74) *Attorney, Agent, or Firm* — Brinks Gilson & Lione

(57) ABSTRACT

Ulstrasound typically in the range 15 KHz to 1 MHz and at a power of about 100 watts over a zone of a few sq. cm is applied via a horn shaped cavity of a transmitter for processing a fluid medium, for example for processing a body of liquid having a foaming surface layer whereby the foaming can be quelled rapidly.

17 Claims, 4 Drawing Sheets

ULTRASONIC TRANSDUCER SYSTEMS

This application is a filing under 35 U.S.C. §371 of International Patent Application PCT/AU2007/000502, filed Apr. 18, 2007, which claims priority to Australian application no. AU 2006902034, filed Apr. 19, 2006.

The present invention relates to an ultrasonic transducer and components for such a transducer wherein there is an attempt to match impedance between the transducer and a medium into which the ultrasound is transmitted. The invention extends to methods of usage of such transducers, which receive ultrasonic energy from a piezo-electric driver to which the transducer is coupled.

A problem in the propagation of ultrasound into a fluid arises because of the large mismatch between the acoustic impedance of conventional transducer materials and that of the fluid. The acoustic impedance of lead zirconium titanate (PZT) is $30\times10^{6}$ rayls and of titanium, $27.3\times10^{6}$ rayls, whereas that of water is $1.49\times10^{6}$ and of air is 413. The mismatch between PZT and water is a factor of 20 and this can be alleviated by placing a material with an intermediate acoustic impedance e.g. plastic, between the PZT and water. Often, in medical applications, a jelly or oil is applied to the surface of a transducer to ensure good contact between the body and the transducer by eliminating any air layer. Clearly, the mismatch between a solid transducer and air, almost $10^{5}$, substantially reduces the propagation of ultrasound.

While there are many uses of high power ultrasound, normally in the frequency range of 15 kHz to 1 MHz, these involve the propagation of ultrasound into solid or liquid media. A particular useful region is around 20 kHz.

The best propagation of sound is believed to occur where the change in acoustic impedance is gradual. For example, matching layers are used in medical ultrasound applications where a plastic layer of a thickness equal to ¼ the wavelength of the sound in the plastic is intermediate between the impedances of the solid transducer and tissue (or water). A series of matching layers may be used and the efficiency of the energy flow will be determined by the number, acoustic impedance and thickness of these layers. This approach is not feasible with propagation from a solid into air because of the magnitude of the change.

Accordingly, there is a need for new and useful approaches to propagate ultrasound into a gaseous medium at power levels at which useful effects can be achieved.

In one aspect, the present invention provides an apparatus for generating an ultrasonic field into a gaseous medium, the apparatus comprising a transducer body operable to provide an ultrasonic output field and an ultrasound transmitter portion adapted to provide a substantial degree of impedance matching with the gaseous medium, the transmitter portion having at least one horn shaped cavity having a throat of relatively reduced dimension transverse to the axis of the cavity and a discharge aperture through which ultrasound is emitted into the gaseous medium and having a relatively enlarged dimension transverse to the axis of the cavity, the arrangement being characterised by the transducer body and the transmitter portion being substantially integral by either having (a) a unitary construction or (b) a face of the transmitter portion being intimately engaged with a corresponding face of the transducer body portion so that in substance there is no gap, whereby a high degree of impedance matching is achieved by the device.

There may be a multiplicity (e.g. 4 per square cm) of such cavities in a closely packed array.

The profile of the horn shape cavities may be exponential or of similar profile.

Embodiments of the invention are especially applicable to the field of high power ultrasonic emitters i.e. those having a power of the order of hundreds of watts.

The surface of the device from which ultrasound is emitted into the gaseous medium can extend over a substantial area e.g. many square centimeters. The device could be circular or could be elongated to distribute the ultrasonic field along a path for a purpose such as defoaming liquid products. For example, filled bottles of carbonated beverage may be defoamed as they move along a conveyer in a fraction of a second.

The present invention in another embodiment subsists in a method of treating in a gaseous medium material by using an apparatus according to the first aspect of the invention and driven to provide an ultrasonic field at sufficient power to affect the material in the medium.

A more specific methodology is defoaming the foam above a liquid body, such as a carbonated beverage which generally will foam when filled into containers. Rapid reduction of the foam to ensure correct filling to a prescribed level can be achieved using embodiments of the invention.

The present invention facilitates embodiments which may be in the form of a compact device for defoaming (and other airborne high power ultrasonic applications). This is exemplified by a transducer having an array of exponentially tapered holes provided in a conventional titanium transducer horn. For simplified explanation for the operation of this transducer one can consider sections through the horn end. As the acoustic wave that is propagating through the device along the cylindrical axis reaches a cross-section immediately before the start of the holes, it is confronted with an acoustic impedance that is the product of the density and velocity of sound in titanium. When the wave reaches the tip of the device, the acoustic impedance is that of air, a factor of 7000 different. If the tapered holes have the right dimensions and appropriate degree of taper, the wave will propagate through the remaining solid around the holes without interference. The density and the velocity of sound at any cross-section along the holes can be approximated by $$p=p_s\cdot A_s/A_t+p_a\cdot A_a/A_t$$

and $$c=c_s\cdot A_s/A_t+c_a\cdot A_a/A_t$$

where $A_s$ and $A_a$ are the cross-sectional areas of the solid and air, $A_t$ is the total horn area, p and c are the density and velocity of sound. Since $A_s/A_t$ at the tip of the device is 0.392 and $A_a/A_t$ is 0.608, the effective acoustic impedance at the horn tip is 4.62 Mrayls. With careful machining, one could reduce the effective acoustic impedance to 1.21 Mrayls, gaining a factor of 20 compared with solid titanium.

If a ¼ wavelength matching layer of a plastic (e.g. methacrylate) is butted to the conventional titanium horn and the tapered holes are made in this material, a further reduction in the acoustic impedance by a factor of approximately 12 can be achieved.

For illustrative purposes only an embodiment of the invention will be described with reference to the accompanying drawings of which, FIG. 1 is a schematic view of the overall system;

Figure 1:
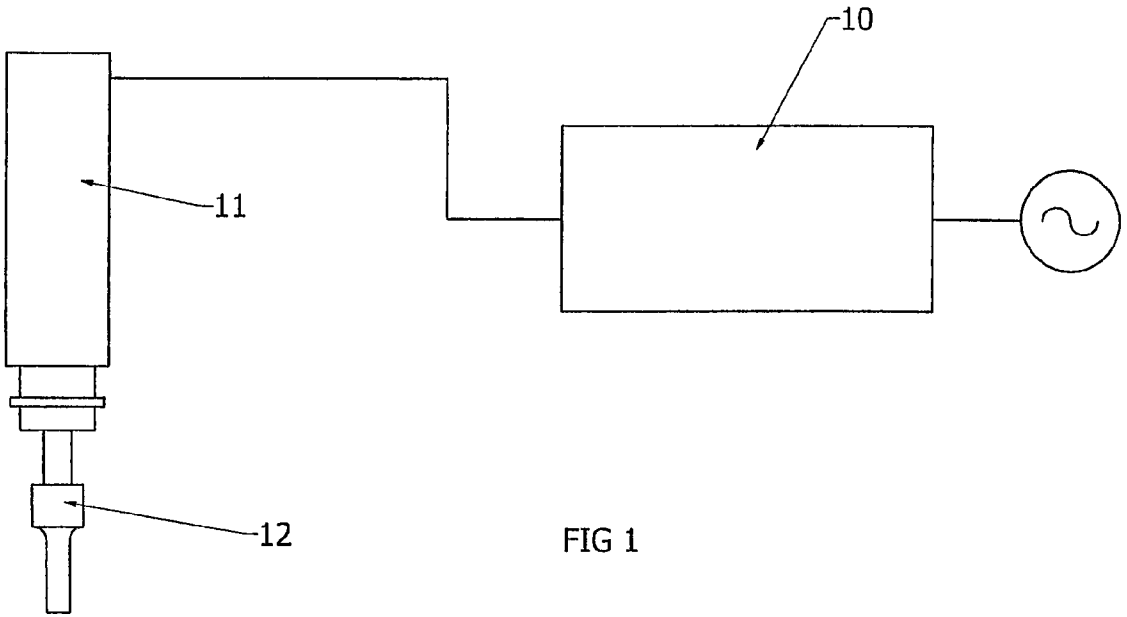

The system in FIG. 1 has a power generator 10 driving a piezo-electric transducer unit 11 adapted to produce an ultrasonic field at a frequency of around or greater than 20 kHz. A unit embodying the invention and known as a sonotrode 12 is connected to a transducer in order to disburse outwardly towards its axial direction an ultrasonic field at relatively high power values.

Figure 4:
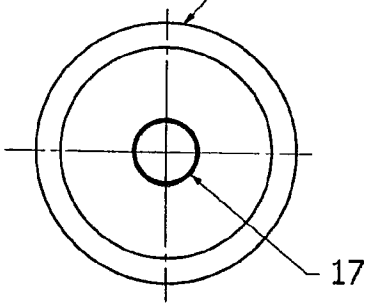
FIG. 4 is a left hand elevation of the unit of FIG. 2.
Figure 2:
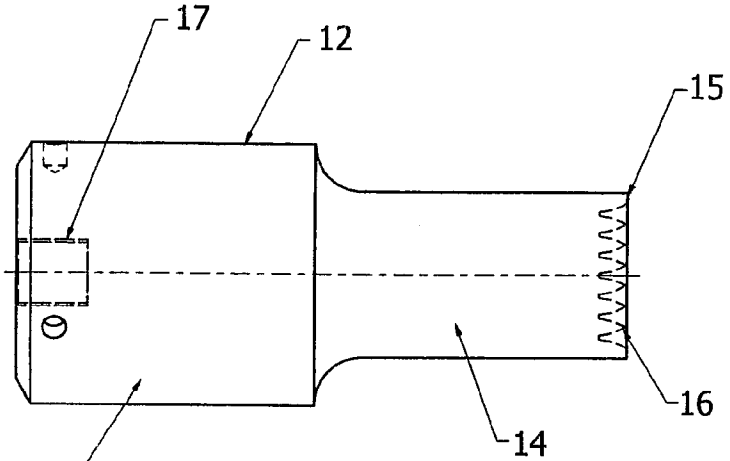
FIG. 2 is a side elevation of an embodiment of the invention.
Figure 3:
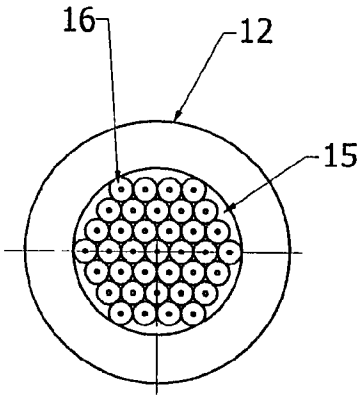
FIG. 3 is a end elevation of the right end of the unit shown in FIG. 2.
Figure 8:
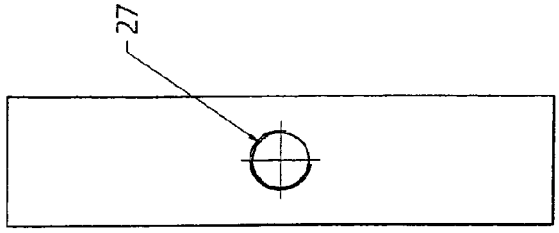
FIG. 8 is a left hand side elevation of the unit of FIG. 4.
Figure 5:
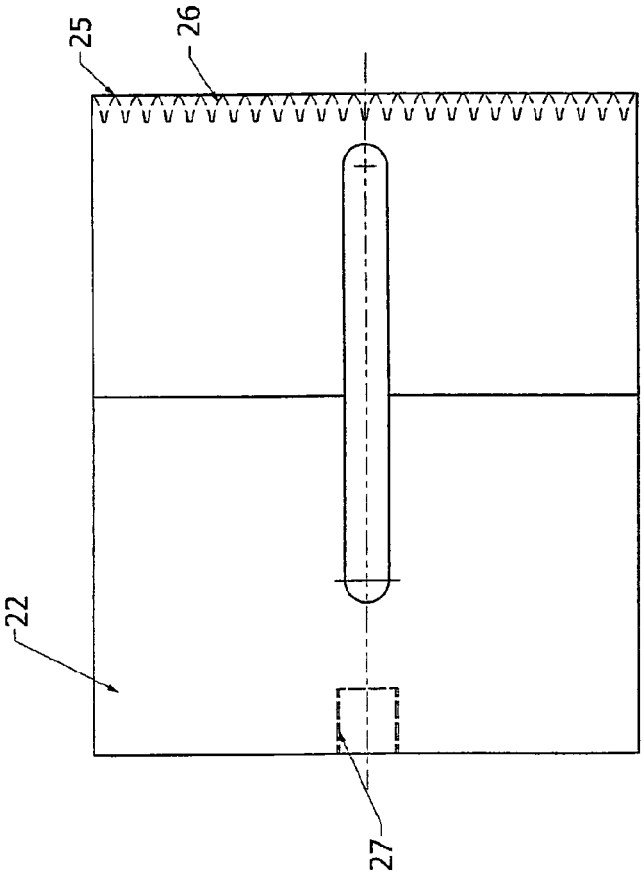
FIG. 5 is a front elevation of a second embodiment.

The sonotrode 12 is shown in more detail in FIGS. 2 to 4. The sonotrode is integrally formed from a suitable material such as a titanium alloy and comprises a body 13 leading to a transmitter portion 14 of cylindrical shape but of reduced diameter terminating in an end face 15 of circular shape having a packed array of horn shaped cavities 16 extending into the transmitter 14. The profile of each horn shaped cavity is essentially exponential with an inner wall of a small as possible diameter at the base of each cavity.

The left hand end of the body 13 has a screw-threaded line bore 17 for screw threadably being fixed onto a corresponding threaded element at the tip of the transducer 11. A rigid connection occurs so that there is efficient transfer from solid to solid of the ultrasonic field developed in the transducer.

Figure 6:
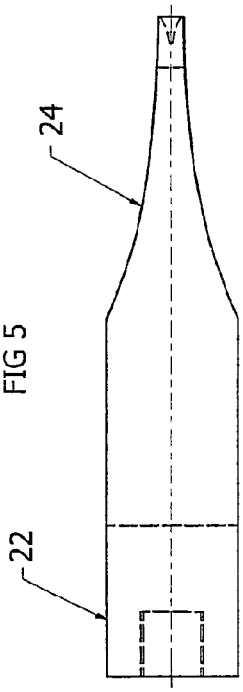
FIG. 6 is a plan view of the embodiment of FIG. 4.
Figure 7:
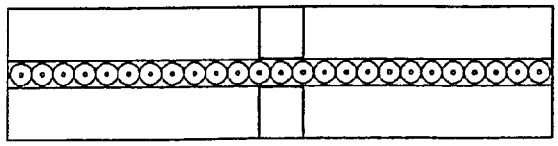
FIG. 7 is a right hand end elevation of the embodiment of FIG. 4.

FIGS. 5 to 8 show a second embodiment wherein the overall structure is elongate or chisel shaped with the tapering transmitter 24 being integrally formed with the rectangular body 22. The right hand end face 25 is planar and exponentially shaped horn cavities 26 are packed in a line as best illustrated in FIGS. 6 and 7. A screw threaded bore 27 is provided in the left hand end of the body as seen and is adapted to be rigidly connected through a screw threaded complimentary element to the transducer.

This embodiment could be mounted with the axes of the horn shaped cavities 26 directed vertically downwardly and thus spaced along a horizontal path under which product to be treated can be moved. For example, in a soft drink beverage plant the ultrasonic field can be used to quell foaming very quickly so bottles can be filled accurately and consistently and eliminate the current substantial wastage in most plants due to inadequately filled bottles being rejected.

Figure 9:
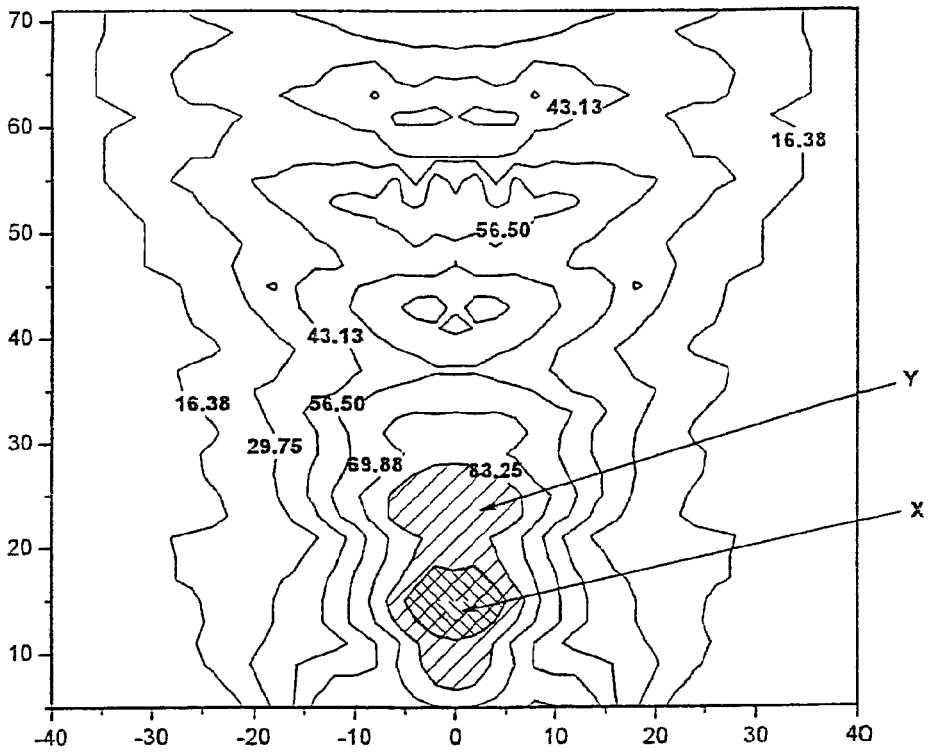
FIG. 9 represents test results of the embodiment of FIG. 2 indicating a measured ultrasonic field strength in a distance spaced in millimeters from and along the axis of the embodiment of FIG. 2.

Referring now to FIG. 9, the results of using the embodiment of FIGS. 2-4 are illustrated. The X axis represents the plane of the end face of the transmitter which in this embodiment extends approximately 15 mm each side of the axis marked "zero" on the scale.

The Y axis of the diagram represents distance in millimeters from the end face 16.

Contour lines indicate boundaries of different intensities of the measured ultrasonic field. Substantially 100% value is achieved in the shaded area marked "X" and the next area around it has a boundary representing 83.25% of maximum value. Other contour lines show the measured field strength. It will be apparent that the ultrasound field transmitted into air has been efficiently transferred over an extended zone suitable for any industrial processing requiring such high strength ultrasonic fields.

One application of the invention is to defoaming products on a production line such as a container filling line for carbonated beverages. When a container is filled before closure a considerable problem is dissolved carbon dioxide coming out of solution and causing a foam which if efficiently quelled would permit reliable and precise filling of the container to the desired volume of the liquid prior to closure of the container.

Other potential applications are dealing with fog, mist or smoke dispersion and acceleratory drying of moist solids eg as they are moved on conveyor belts.

The invention claimed is:

1. An apparatus for generating an ultrasonic field into a gaseous medium, the apparatus comprising:

an ultrasound transmitter body adapted to provide a substantial degree of impedance matching with the gaseous medium and adapted to be excited by an ultrasonic transducer for propagating a signal along an axis to an end wall of the body;

wherein the transmitter body comprises a substantially integral transmitter portion having at least one blind cavity with a horn-shaped profile extending into the transmitter portion from the end wall from a discharge aperture through which ultrasound is emitted into the gaseous medium, the at least one blind cavity reducing in diameter to terminate in a closed end that is disposed within the transmitter portion, whereby a high degree of impedance matching is achieved by the apparatus.

2. An apparatus as claimed in claim 1, wherein the transmitter portion comprises a multiplicity of similar blind cavities having horn-shaped profiles.

3. An apparatus as claimed in claim 2, wherein a closely packed array of about 4 cavities per sq. cm. are provided.

4. An apparatus as claimed in claim 1, wherein each cavity has substantially all of its wall profile of a substantially exponential profile.

5. An apparatus as claimed claim 1, wherein the transmitter body is adapted to be driven at a frequency of 20 kHz to 1 MHz.

6. An apparatus as claimed in claim 1, wherein the transmitter body is adapted to be driven at a power of the order of one hundred watts or more.

7. An apparatus as claimed in claim 1, wherein the area of the discharge aperture is of the order of a few sq. cm.

8. An apparatus as claimed in claim 1, wherein the apparatus further comprises a rigid support onto which the transmitter body is rigidly mounted and the support is adapted to be coupled to the transducer.

9. An apparatus as claimed claim 1 in combination with the transducer which is adapted to apply ultrasound in the range 15kHz to 1MHz and at a power of about 100 watts over a zone of a few sq. cm.

10. An apparatus as claimed claim 1 wherein an array of side by side blind cavities having horn-shaped profiles are provided to extend along a path extending at right angles to the axial direction along which the cavities extend.

11. A method of treating a target located in a gaseous medium to affect the target comprising using an apparatus as defined in claim 1.

12. A method of defoaming a body liquid having an associated foam portion comprising applying ultrasound at a frequency in the range 15 kHz to 1 MHz and a power of about 100 watts over a zone of a few sq. cm., wherein the ultrasound is applied by an apparatus as claimed claim 1 to the foam portion adjacent a discharge port from the or each blind cavity having a horn-shaped profile.

13. A method of filling a container with a liquid which is susceptible to foaming comprising discharging liquid into a container, applying a method as claimed in claim 12 to at least limit foaming and subsequently closing the container.

14. A method as claimed in claim 13, wherein the container is moved along a processing path after receiving the liquid and the method of limiting foam is applied along the path and over each container.

15. A product defoamed by the method of in claim 11.

16. An apparatus for generating an ultrasonic field into a gaseous medium, the apparatus comprising:

an ultrasound transmitter body adapted to provide a substantial degree of impedance matching with the gaseous medium and adapted to be excited by an ultrasonic transducer for propagating a signal along an axis to an end wall of the body;

wherein the body comprises a substantially integral transmitter portion that has a multiplicity of blind cavities having horn-shaped profiles extending into the transmitter portion from the end wall from a discharge aperture through which ultrasound is emitted into the gaseous medium, each of said blind cavities reducing in diameter to terminate in a closed end that is disposed within the transmitter portion, whereby a high degree of impedance matching is achieved by the apparatus;

and wherein about four blind cavities having horn-shaped profiles per sq. cm. are provided in a packed array.

17. An apparatus as claimed in claim 16, wherein each cavity has substantially all of its wall profile of a substantially exponential profile.

* * * * *

UNITED STATES PATENT AND TRADEMARK OFFICE

CERTIFICATE OF CORRECTION

PATENT NO. : 8,763,927 B2
APPLICATION NO. : 12/226462
DATED : July 1, 2014
INVENTOR(S) : Anthony Collings et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1212 days.

Signed and Sealed this
Seventeenth Day of November, 2015

Michelle K. Lee

Michelle K. Lee
*Director of the United States Patent and Trademark Office*